US006166312A

United States Patent [19]

Brewster et al.

[11] Patent Number: 6,166,312

[45] Date of Patent: Dec. 26, 2000

[54] DRUM BEATER FOR BASS DRUM

[75] Inventors: Matthew Brewster, Leicester; John Brown, Blaby, both of United Kingdom

[73] Assignee: Premier Percussion Limited, Leicestershire, United Kingdom

[21] Appl. No.: 09/308,859

[22] PCT Filed: Dec. 5, 1997

[86] PCT No.: PCT/GB97/03261

§ 371 Date: May 26, 1999

§ 102(e) Date: May 26, 1999

[87] PCT Pub. No.: WO98/25258

PCT Pub. Date: Jun. 11, 1998

[30] Foreign Application Priority Data

Dec. 6, 1996 [GB] United Kingdom ..... 9625401

[51] Int. Cl.[7] ..... G10D 13/02

[52] U.S. Cl. ..... 84/422.1; 84/422.2

[58] Field of Search ..... 84/422.1, 422.2, 84/422.3

[56] References Cited

U.S. PATENT DOCUMENTS

| | | | |
|---|---|---|---|
| 1,437,173 | 11/1922 | Danly . | |
| 3,055,254 | 9/1962 | Haviland | 84/422 |
| 3,426,640 | 2/1969 | Slingerland, Jr. | 84/422 |
| 3,618,441 | 11/1971 | Fearns | 84/422.1 |
| 4,488,471 | 12/1984 | Youakim | 84/422.3 |
| 4,520,710 | 6/1985 | Elliott, Jr. | 84/422 |
| 4,538,499 | 9/1985 | Livingston | 84/422 |
| 4,945,802 | 8/1990 | Ruprecht | 84/422 |
| 5,297,467 | 3/1994 | Hoshino | 84/422.1 |
| 5,301,592 | 4/1994 | Johnston | 84/422.1 |

FOREIGN PATENT DOCUMENTS

| | | |
|---|---|---|
| 931811 | 8/1955 | Germany . |
| 2211013 | 6/1989 | United Kingdom . |
| WO 97/06526 | 2/1997 | WIPO . |

*Primary Examiner*—David Martin
*Assistant Examiner*—Shih-yung Hsieh
*Attorney, Agent, or Firm*—Townsend and Townsend and Crew LLP

[57] ABSTRACT

A pedal operated drum beater device (20) comprises a pedal (22) and a drum beater (24) mounted on shaft (36). The pedal (22) is coupled to shaft (36) by linkages (38, 40) such that depressing the pedal causes the shaft (36) to rotate, advancing the drum beater (24) from a rest position to an operative position. The downward movement of the pedal (22) is opposed by the resilience of elastomeric strip (26) which stretches and bends as the drum beater (24) moves into the operative position. The device (20) is attached to a drum by drum clamp (82), formed in two parts which consist of a drum-mounted rim clamp and a device-mounted, clamp holder. The rim clamp and clamp holder are releasably interlockable through pivotal engagement.

5 Claims, 11 Drawing Sheets

DRUM BEATER FOR BASS DRUM

TECHNICAL FIELD

The present invention relates to a pedal operated drum beater device.

BACKGROUND ART

Pedal operated drum beater devices are well known and are commonly used with bass drums. It has been found that the performance of certain musicians is hampered when using conventional devices. One of the problems encountered relates to the spurious noise generated by the moving parts within the known device; and another relates to the delayed return of the pedal to its staring position after the drum beater has struck the drum. Yet another problem with known drum pedals concerns accurate positioning of the drum pedal relative to the bass drum.

Patent specification U.S. Pat. No. 4,520,710 discloses a drum pedal assembly having an inherent escapement mechanism. A drum beater is suspended from a shaft which is rotated by downward movement of the foot pedal. After rotation to strike a drum, the drum beater returns to its rest position under the action of gravity once the downward force on the pedal is removed. The assembly is designed such that the drum beater counter-balances the foot pedal, decreasing the need for a spring typically employed to provide the escapement or return force. However, for faster return action, a secondary escapement force may be provided by an elastic band suspended between frame posts which support the shaft. As the drum beater is rotated into the strike position, the elastic band is stretched into a bowed configuration.

U.K. patent application published as GB 2211013A addresses the problem of accurate positioning of the drum pedal relative to the bass drum. In fact, the specification relates to a support for holding the drum at a prescribed beating position at a selected height and tilt orientation. The support includes a cradle which contacts the curved periphery of a drum in two spaced locations. When positioned in the cradle, the drum is tilted forward such that a leg, attached to the front hoop of the drum, rests in a stopper. Thus, direct clamping of the drum pedal to the drum is avoided.

An object of the present invention is to provide a pedal operated drum beater device which addresses at least one of the aforementioned disadvantages of conventional devices.

DISCLOSURE OF THE INVENTION

In accordance with a broad aspect of the present invention, there is provided a pedal operated drum beater device comprising a drum beater which is restored to a rest position from an operative position by a biasing force substantially generated by a resilient member, characterised in that the resilient member comprises an elastomeric material. Preferably the biasing force is generated by stretching of the resilient member as the drum beater advances from the rest position to the operative position. The elastomeric member may provide the majority of the biasing force, particularly if the rebound energy from the beater striking the drum is discounted.

Conventionally, with drum pedals with an overarm action, the resilient member is a metal coil spring. Surprisingly, the present applicant has found that the use of an elastomeric material in place of a metal spring offers a number of advantages. Firstly, the elastomeric material enables the drum beater to be operated more quickly as it makes it possible to restore the pedal to its starting position more rapidly. Secondly, the elastomeric material flexes silently which is not always the case with a metal coil spring where adjacent turns may clash together. Furthermore, the elastomeric material appears to have a beneficial effect on the "feel" of the pedal to musicians. This may be because the elastomer provides more uniform resistance to the complex forces exerted on it during each drum beat cycle. Mechanical hysteresis in the elastomeric material during operation may also play a role in the improved feel of the drum pedal of the present invention.

A preferred elastomeric material is natural rubber. Detailed testing has demonstrated that natural rubber is ideally suited to withstand the fatigue of prolonged and repeated use.

In one embodiment, the drum beater is mounted on a shaft which is rotated by operation of the pedal. Preferably, the pedal is coupled via a rigid link to a lever mounted on the shaft, the rigid link being pivotally connected to the lever and to the pedal.

A flexible linkage such as a chain or strap is commonly used to couple the pedal to the shaft. Flexible linkages are susceptible to "lash back", an undesirable occurrence caused when the pedal is brought to a sudden stop once it is restored to the rest position. Furthermore, flexible linkages are prone to generate noise particularly where a chain engages a sprocket mounted on the shaft. The use of a rigid link obviates these difficulties.

The lever may comprise means varying the spacing between the shaft and pivotal connection between the rigid link and the lever. This adjustment has an effect on the torque transmitted to the shaft. Increasing the spacing means that less effort from the musician is required to impart a given momentum to the drum beater, other factors being equal.

The drum beater may be substantially aligned with the central or medial plane of the pedal (that is, a plane substantially bisecting the drum pedal and aligned with the longitudinal axis of the drum pedal), and the lever on the shaft may be offset from the drum beater. Commonly, flexible linkages are aligned centrally, with the drum beater positioned off-centre. With such an arrangement, it is necessary to off-set by a similar amount the drum clamp which attaches the device to a drum, giving the whole apparatus a tendency to be lopsided. In contrast, a centrally aligned drum beater leads to improved overall balance.

In one arrangement, the pedal is pivotally mounted in a frame supporting the shaft, the pivotal axis being parallel to the shaft. The frame may be adjustable such that the spacing between the pivotal axis and shaft may be varied. By varying the spacing, the inclination of the pedal is altered and consequently the "feel" of the device to a musician changes.

The frame may comprise a base and a pillar in which the shaft is mounted, the pillar projecting from the base. The pillar may have a forward sweep such that the part of the pillar adjacent the shaft overhangs the part of the pillar adjacent the base. Thus, the pillar may be inclined away from the pivotal connection between the pedal and frame. The forward sweep of the pillar facilitates positioning of the device in front of a bass drum, and provides additional room for clamping the device to the drum.

The pedal operated drum beater device may comprise means for applying a tensile stress to the resilient member when the drum beater is in the rest position. Pre-stressing in this way enables the "feel" of the device to be adapted to the specific requirements of each musician. The tensile stress applying means may comprise a carriage and a stop, with the resilient member supported therebetween, the position of the carriage with respect to the stop being controlled to vary the tensile pre-stress applied to the resilient member.

The drum beater may comprise a beater head attached to a rod, wherein the rod is releasably held in a clamp mounted on the shaft. The releasable clamp arrangement enables the separation of the beater head from the shaft to be varied to suit the particular size of drum in front of the device. The position of the clamp around the shaft may be adjustable to enable the musician to control the angular position of the drum beater around the shaft. For example, the drum beater may be set at 60° to the floor when in the rest position.

The clamp for mounting the rod on the shaft may comprise two parts, one of which engages the rod in between spaced positions where the other part engages the rod when the two parts are urged together. In this way, the rod is securely supported, there being at least three staggered points of contact, one of which is on the opposite side of the rod to the others.

The beater head may have a profile which is substantially flat in one direction, the direction being aligned substantially parallel to the shaft axis, and possibly perpendicular to the axis of the rod. Such a profile enables an elongate region of the beater head to make contact with the playing surface of a drum during percussion.

The pedal operated drum beater device may include a drum clamp for attaching the device to a drum, wherein the drum clamp is mounted on an adjustable member, movement of the adjustable member determining the position of the clamp with respect to the rest of the device. The adjustable member enables the distance between the device and the drum to be varied which may have an effect on where and how the drum beater makes contact with the playing surface of the drum.

The pedal may comprise an elongate portion and a plate, the plate being moveable along the length of the elongate portion. The plate provides a 'target' for the ball of the musician's foot.

In accordance with another aspect of the present invention, there is provided a pedal operated drum beater device of the kind having an overarm action (ie drum beater superposed, and not suspended) comprising a drum beater which is restored to a rest position from an operative position by a resilient member, characterised in that the resilient member comprises an elastomeric material. In accordance with yet another aspect of the present invention, there is provided a pedal operated drum beater device comprising a rotatably mounted drum beater which is restored to a rest position from an operative position by recovery of a resilient member, characterised in that the resilient member comprises an elastomeric material aligned to flex in a plane substantially perpendicular to the rotation axis of the drum beater. Preferred features of the additional aspects of the invention are defined in the dependent claims to the first aspect of the invention.

According to another aspect, the present invention provides apparatus for coupling a pedal operated drum beater device to a drum, comprising a first part having means for attachment to the rim of the drum, and a second part which in use is attached to the pedal operated drum beater device, the first and second parts being releasably interlockable. The parts may interlock through the pivotal engagement of one part with the other.

The pivotal engagement may be such that the playing surface of the drum is pivotable towards the pedal operated drum device in order to interlock the parts. The pivotal engagement may thus allow pivotal movement about a horizontal axis, lateral to the longitudal extent of the pedal. The pivotal coupling may provide a degree of flexibility in the selection of the orientation of the drum with respect to the pedal operated drum beater device. The coupling also allows for rotational movement between the drum and the device when the parts are no longer interlocked which may prevent damage to the drum rim.

The first and second parts may comprise a member attached to one part and a recess in the other part, the member being nested in the recess. Preferably, the member has a curved periphery, with the recess having a corresponding profile. The curved surfaces facilitate rotational movement of the member within the recess.

In a preferred form, one of the parts comprises a resilient portion which bears against the other part, urging the member into the recess, when the parts are interlocked. The two parts may interlock through a snap-fit.

BRIEF DESCRIPTION OF THE DRAWINGS

Embodiments of the inventions will now be described, by way of example, with reference to the accompanying Figures in which.

MODES OF CARRYING OUT THE INVENTION

Figure 1:
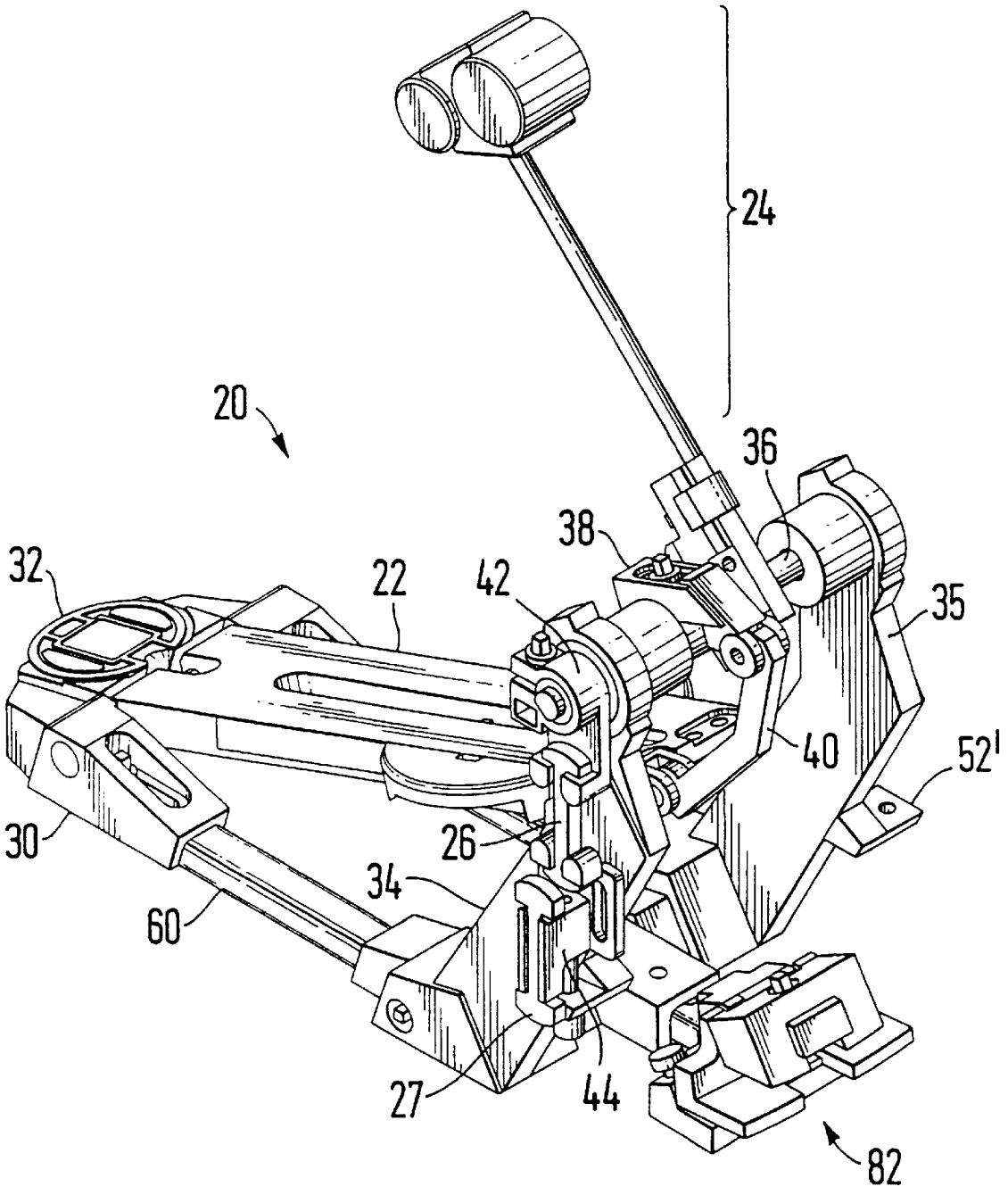
FIG. 1 shows a perspective view of a pedal operated drum beater device embodying the present invention.
Figure 2:
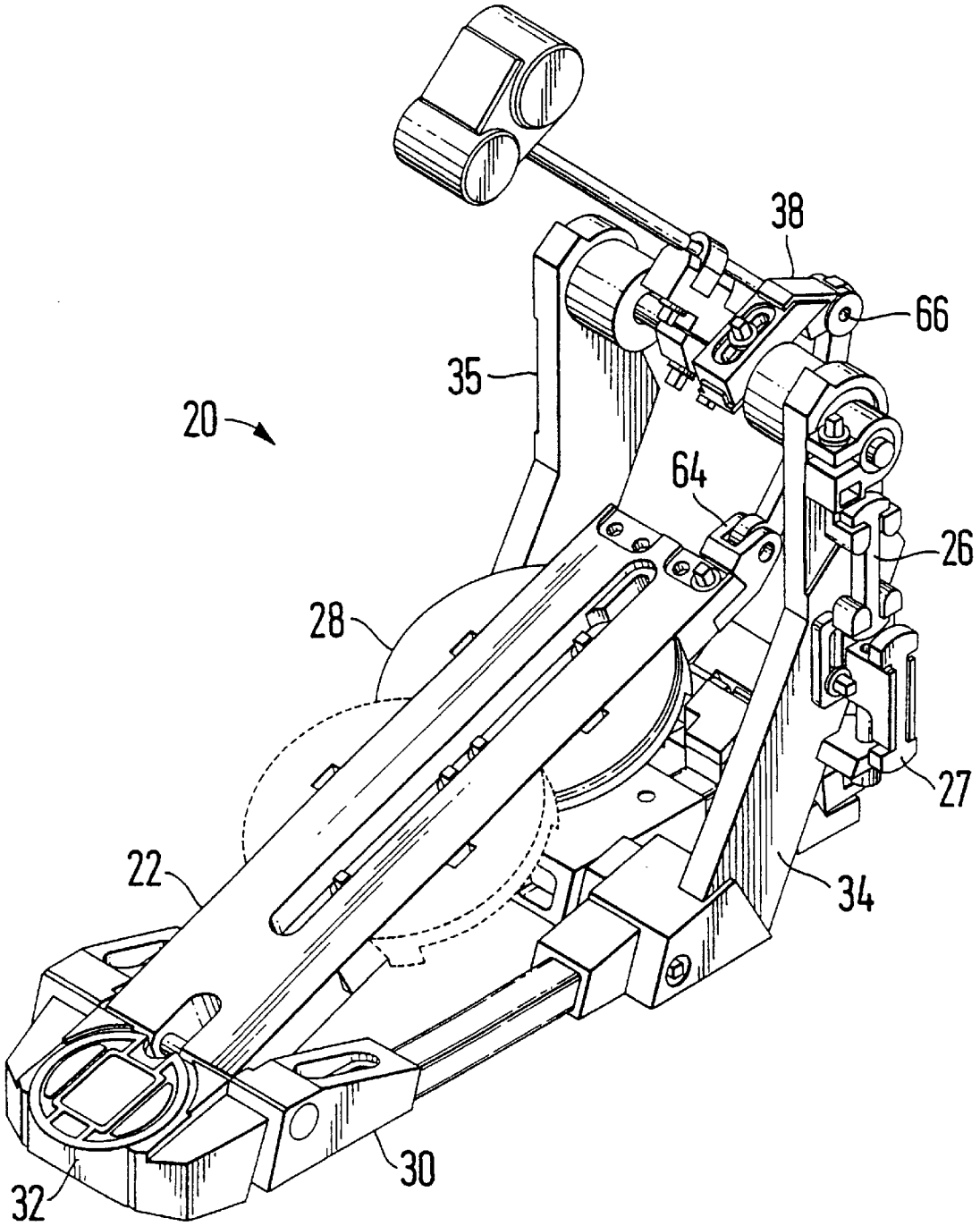
FIG. 2 shows a reverse perspective view of the device of FIG. 1.
Figure 6:
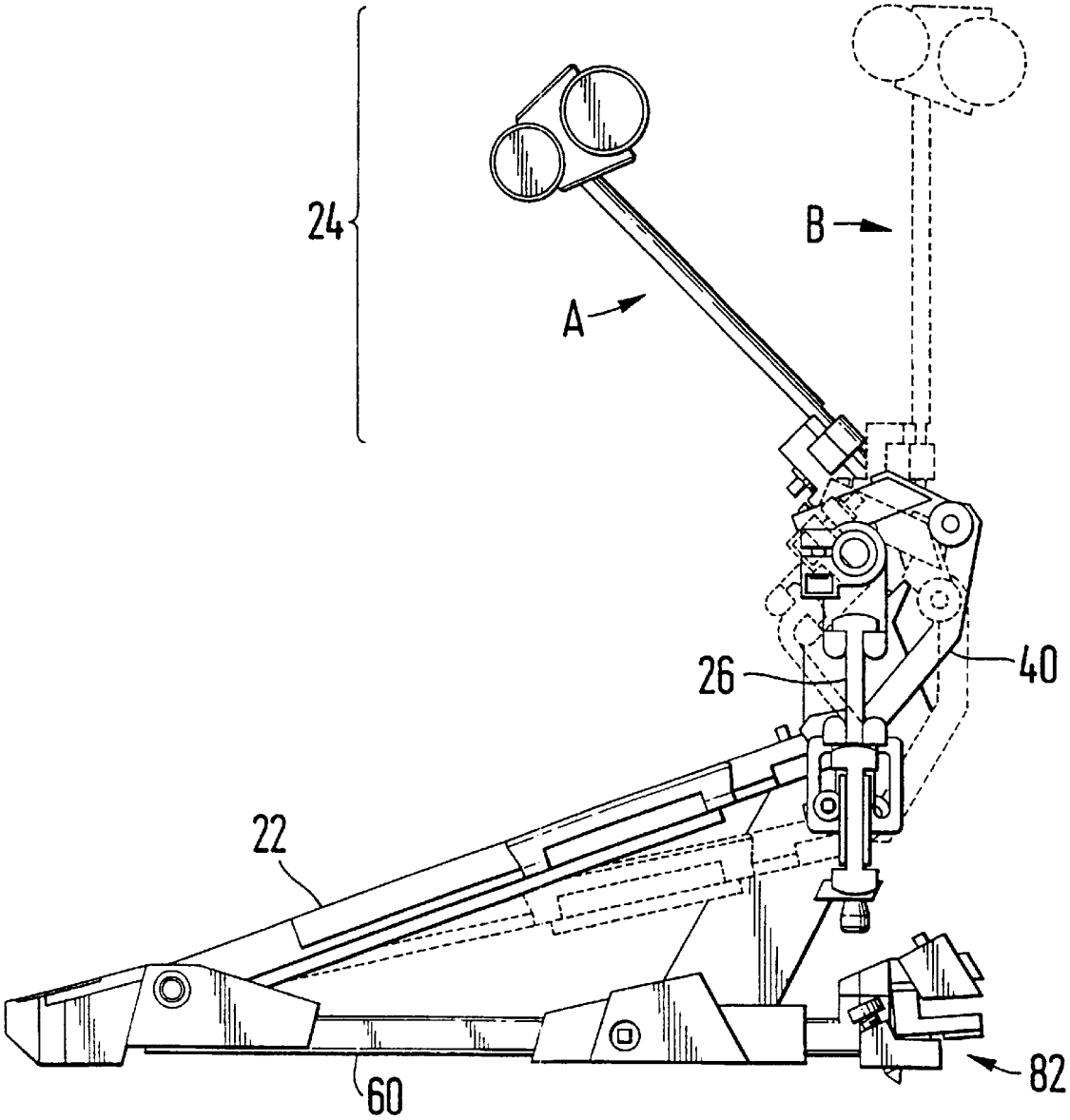
FIG. 6 shows a side elevation of the device of FIG. 1 and illustrates the drum beater action.
Figure 7:
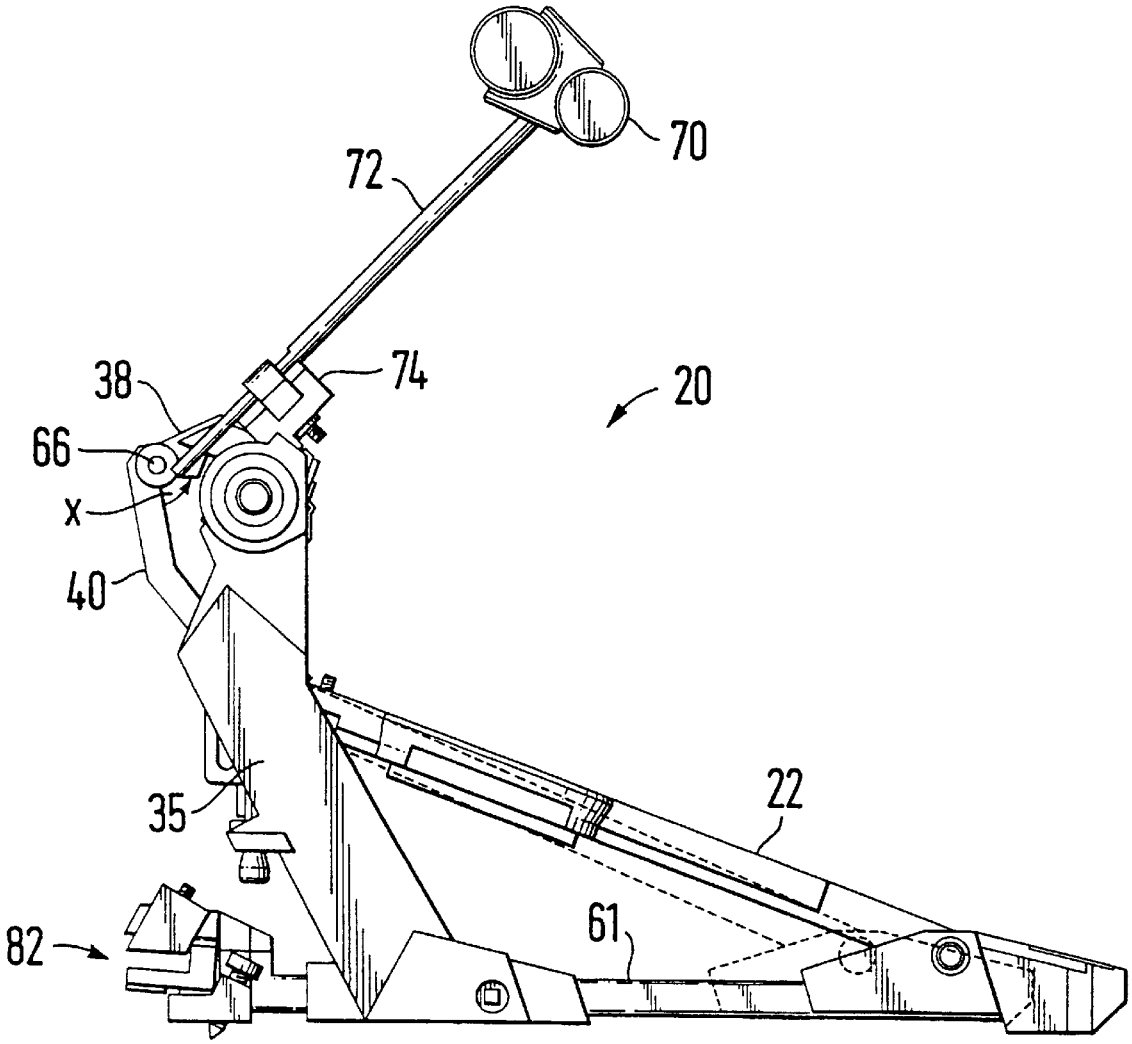
FIG. 7 shows a side elevation of the device of FIG. 1 and illustrates pedal adjustment.
Figure 8:
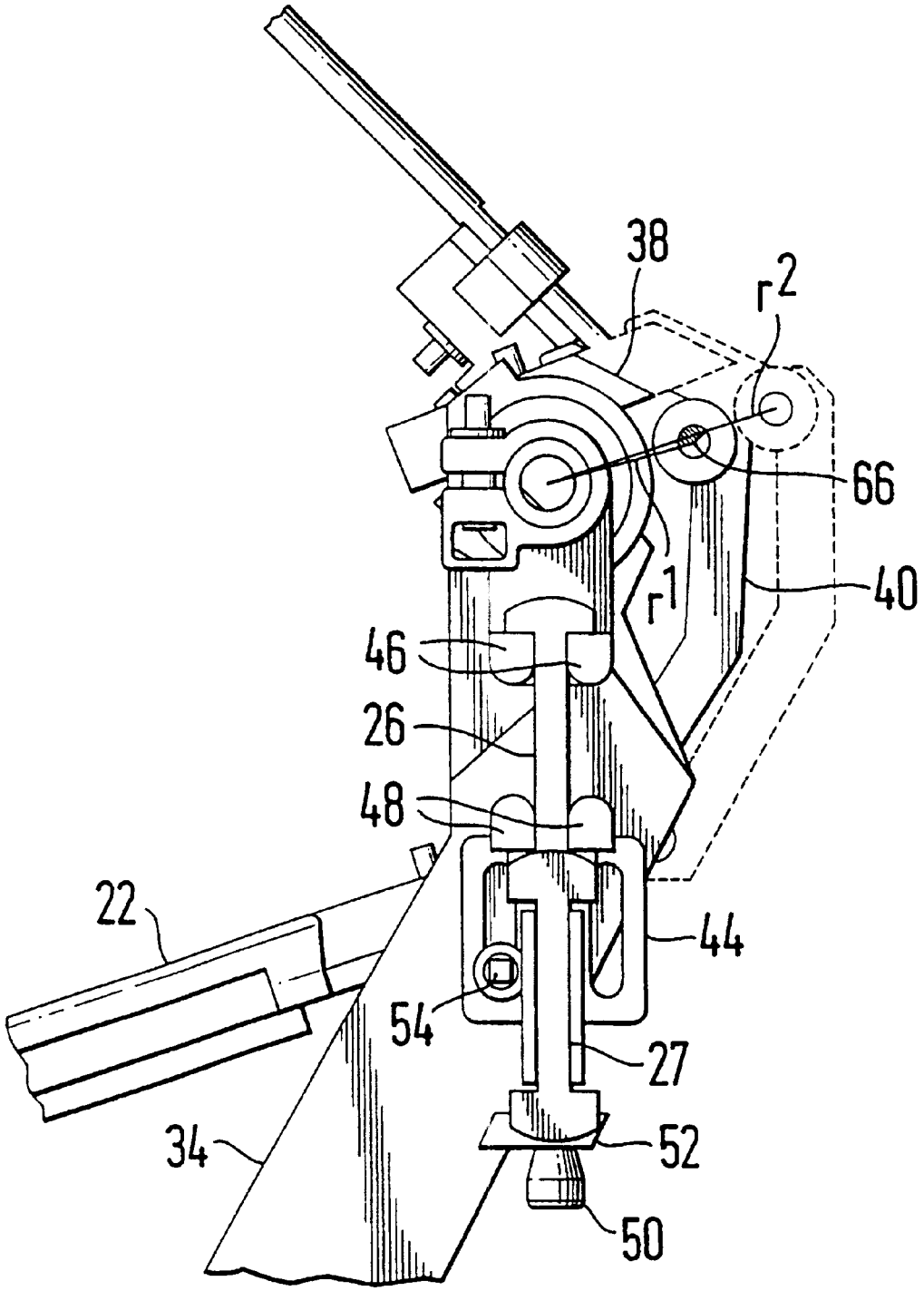
FIG. 8 shows component detail of the drum beater mechanism of the device of FIG. 1.
Figure 9:
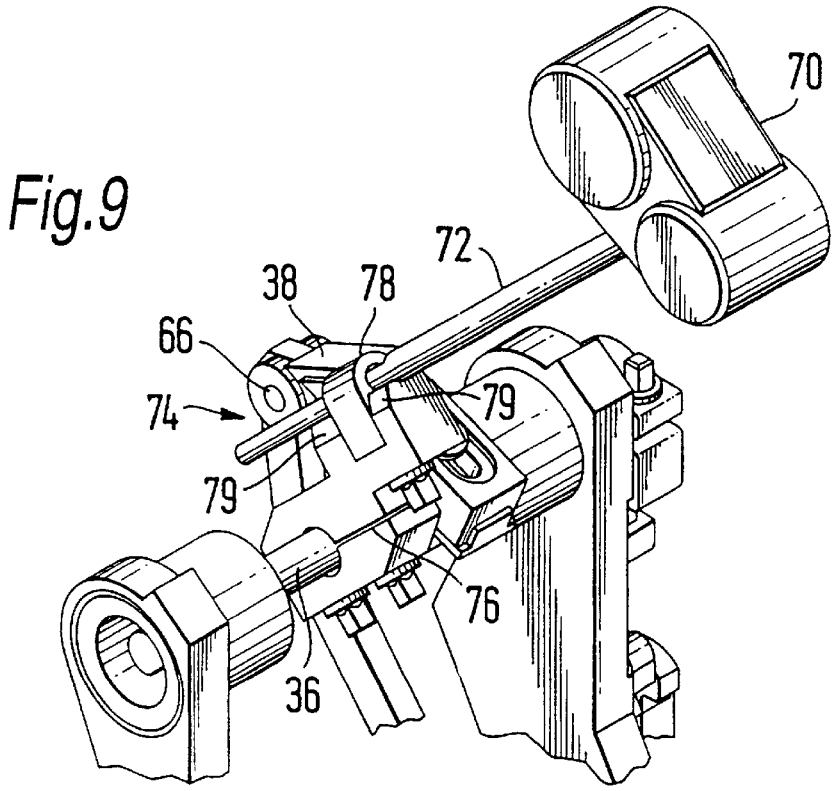
FIG. 9 shows component detail of the drum beater of the device of FIG. 1.

FIG. 1 shows a pedal operated drum beater device 20 comprising a pedal 22 and a drum beater 24. As shown in FIG. 6, depressing the pedal 22 causes the drum beater 24 to advance from a rest position (A) to an operative position (B) shown in phantom lines. The downward movement of the pedal 22 is opposed by the resilience of elastomeric strip 26, which stretches and bends as the drum beater 24 advances to the operative position. As soon as the downward force on the pedal 22 is released, the elastomeric strip 26 pulls the drum beater 24 back to the rest position, restoring the pedal 22 to its starting position.

Figure 3:
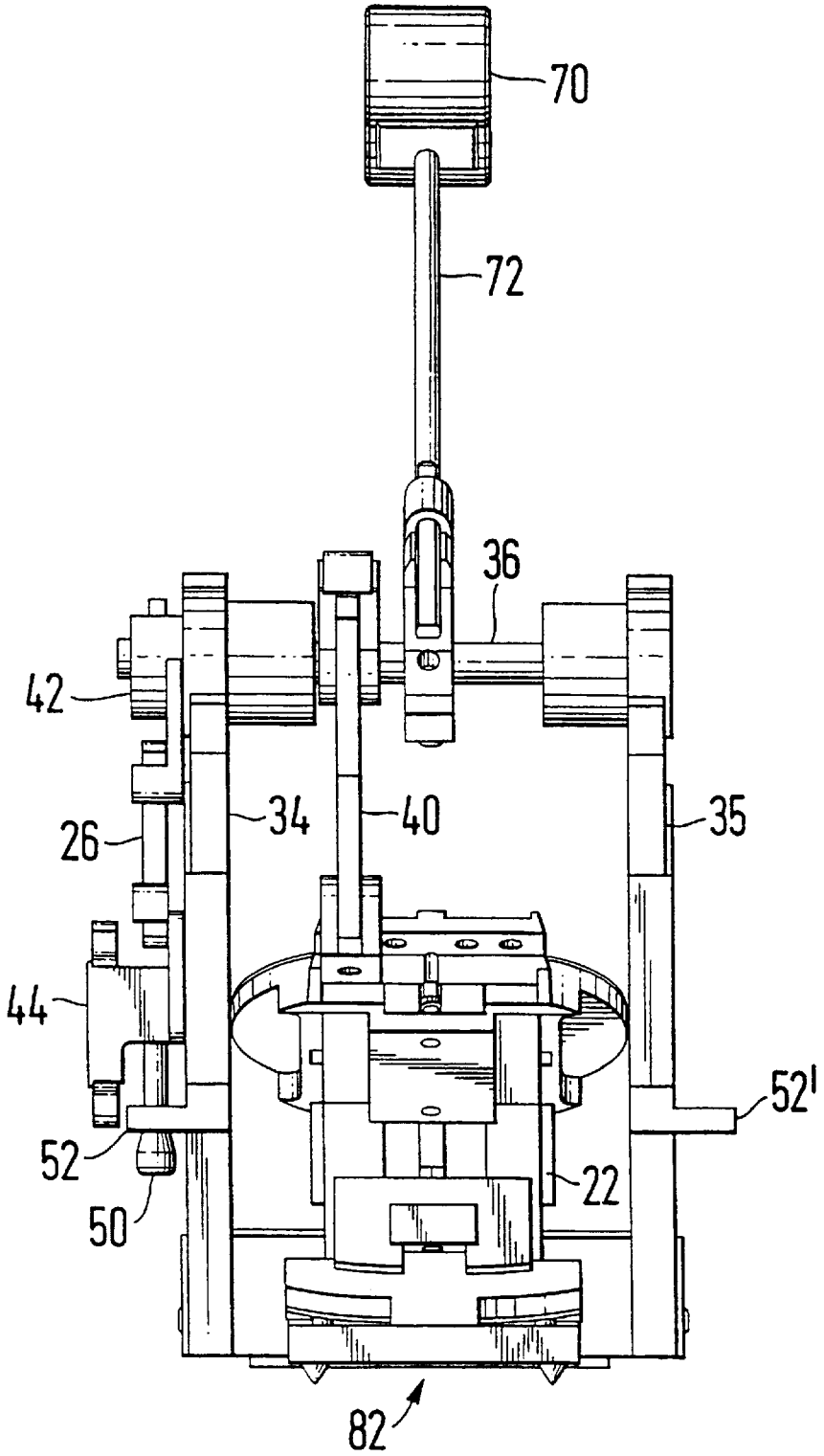
FIG. 3 shows a front elevation of the device of FIG. 1.
Figure 4:
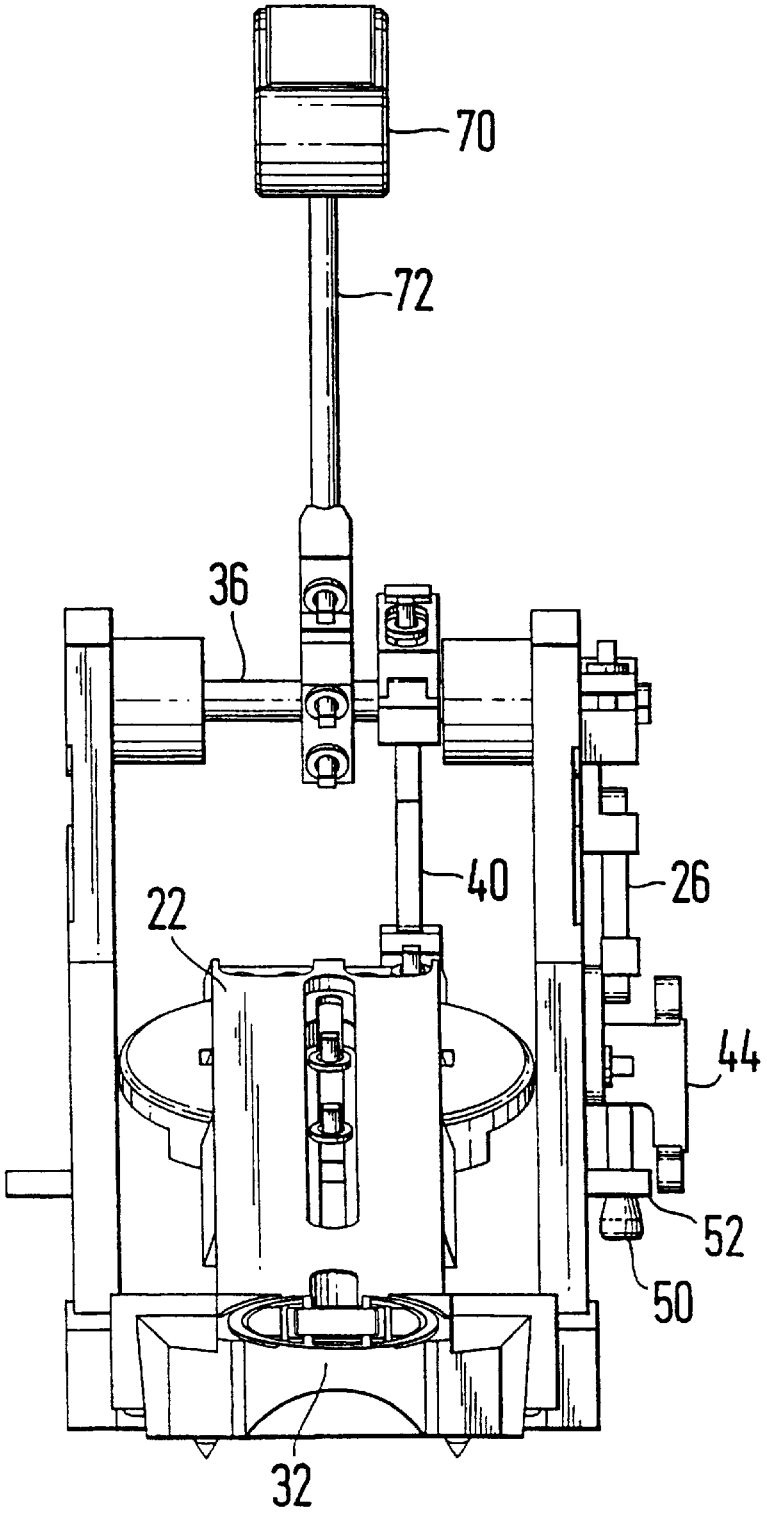
FIG. 4 shows a rear elevation of the device of FIG. 1.
Figure 5:
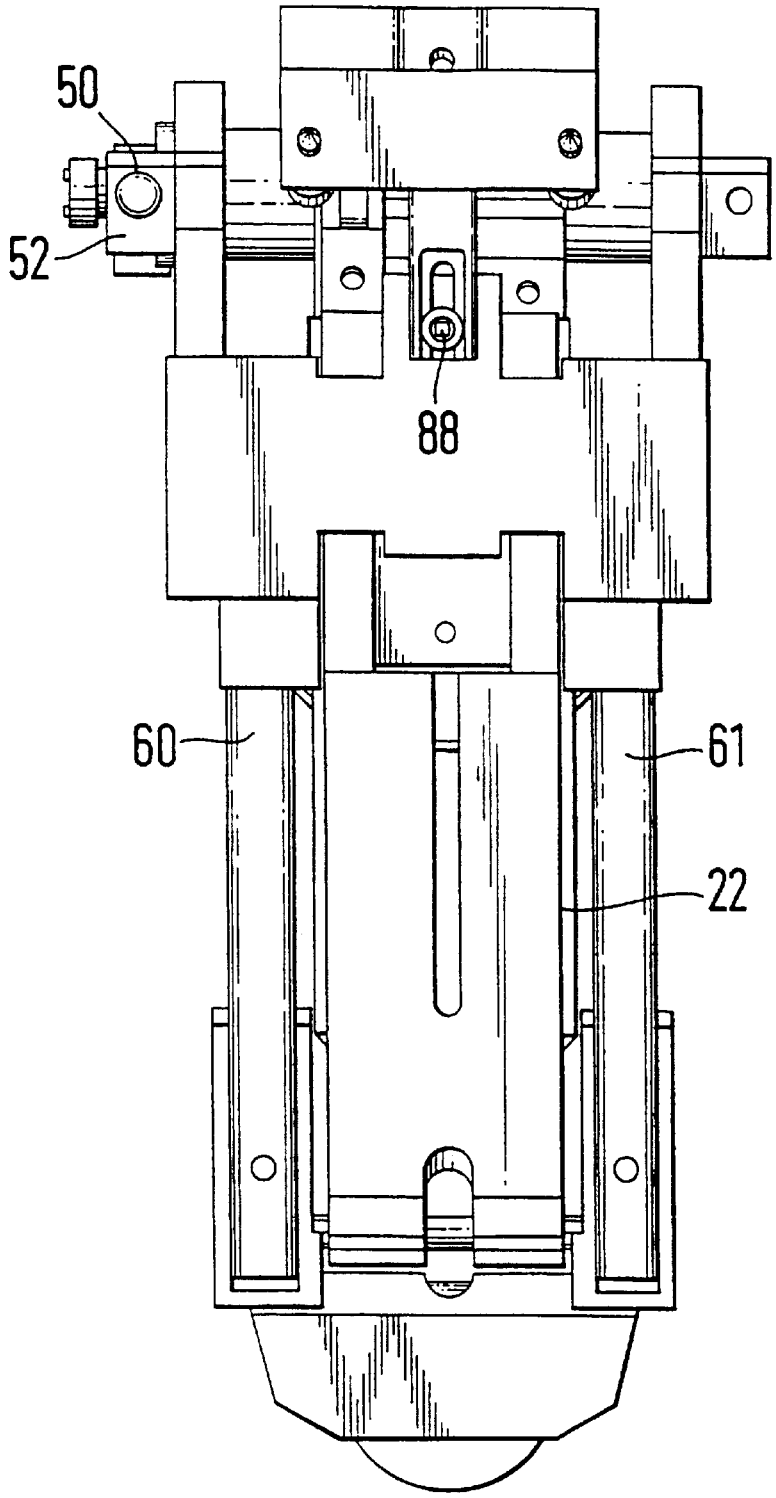
FIG. 5 shows a bottom plan view of the device of FIG. 1.

A plate 28 is mounted on pedal 22 and is positioned along its length according to where the ball of a musician's foot presses against the pedal 22. The pedal 22 is pivotally mounted in frame 30 which includes a rest 32 for the heel of the musician's foot and pillar-like supports 34 and 35. The supports 34, 35 are inclined away from the heel rest 32. The drum beater 24 is mounted on a shaft 36 which is journalled in supports 34, 35. As seen from FIG. 3, the drum beater 24 and pedal are centred around a plane passing through the middle of device 20. A lever 38 is also mounted on the shaft 36, on one side of the drum beater 24, and is pivotally coupled via rigid link 40 to the pedal 22. In this way, as the pedal 22 pivots downwards, the link 40 exerts a force on lever 38 which rotates the shaft 36, thereby advancing the drum beater 24 into the operative position.

A cam 42 is mounted on one end of shaft 36 and is coupled to the uppermost part of elastomeric strip 26. The lowermost part of the elastomeric strip 26 is attached to carriage 44 which is anchored to support 34. The elastomeric strip 26 has widened end portions 46 which bear against pairs of lugs 48 on the cam 42 and the carriage 44. As the shaft 36 rotates to advance the drum beater 24 into the operative position, the cam 42 rotates, stretching and bending the elastomeric strip 26. As soon as the downward force on the pedal 22 is removed, the elastomeric strip 26 contracts, pulling on the cam 42 and restoring the drum beater 24 to its rest position.

The carriage 44 is anchored to the support 34 by a bolt 50. The shaft of the bolt 50 passes through a hole in rest 52, which is attached to the support 34, and screws into a threaded bore in the carriage 44. The head of the bolt 50 bears against the rest 52 when there is no slack in the elastomeric strip 26. If the bolt 50 is screwed further into the carriage 44, the carriage is pulled further away from shaft 36, resulting in a tensile force being applied to the elastomeric strip 26 when the drum beater 24 is in the rest position. A locking screw 54 may be engaged to pin the carriage 44 firmly to the support 34. The carriage 44 carries a replacement elastomeric strip 27.

The frame 30 comprises a first part which includes the heel rest 32 and a second part which includes the supports 34, 35. The first part is mounted on runners 60, 61 which are attached to the second part. When the desired frame size is chosen, locking screws are tightened to hold the first part rigidly to the runners 60, 61. Adjusting the frame size in this way has an effect on the position of the pedal 22. By moving the first and second parts closer together, the pedal 22 becomes more steeply inclined to the horizontal. As the inclination of the pedal 22 increases, so the position of the pivotal connection 64 between the pedal 22 and rigid link 40 changes. The change results in an increase in the magnitude of the angle (X) at the pivotal connection 66 between the lever 38 and rigid link 40.

The effective length of lever 38 is adjustable. The lever 38 is releasably mounted on the shaft 36, enabling the spacing (r) between the shaft and pivotal connection 66 to be varied between the limits $r^1$ and $r^2$. By increasing the spacing from $r^1$ to $r^2$, the torque applied to the shaft increases, if the force pivoting the pedal 22 remains constant. The lever 38 therefore influences the "feel" of the drum beating action to a musician.

The drum beater 24 comprises a drum head 70 attached to one end of a rod 72. The rod 72 is held in clamp 74 which itself is mounted on the shaft 36 with clamp 76. The shaft 36 is splined to provide a firm gripping surface for clamp 76. The jaws 78, 79 of clamp 74 are staggered with respect to each other, such that they engage the rod in three locations, with jaw 78 engaging the opposite side of rod 72 to the spaced jaws 79. The clamp 76 enables the drum beater 24 to be mounted at different orientations with respect to the lever 38. The rest position of the drum beater 24 may thus be adjusted by the musician.

The beater head 70 is reversible and comprises two cylinders, one of a relatively hard material such as nylon and the other of a relatively soft material such as felt. The cylinders are aligned with their longitudinal axes substantially perpendicular to the rod axis. In use, the curved surface of one of the cylinders preselected by the musician makes contact along its entire length with the playing surface of the drum.

Figure 10:
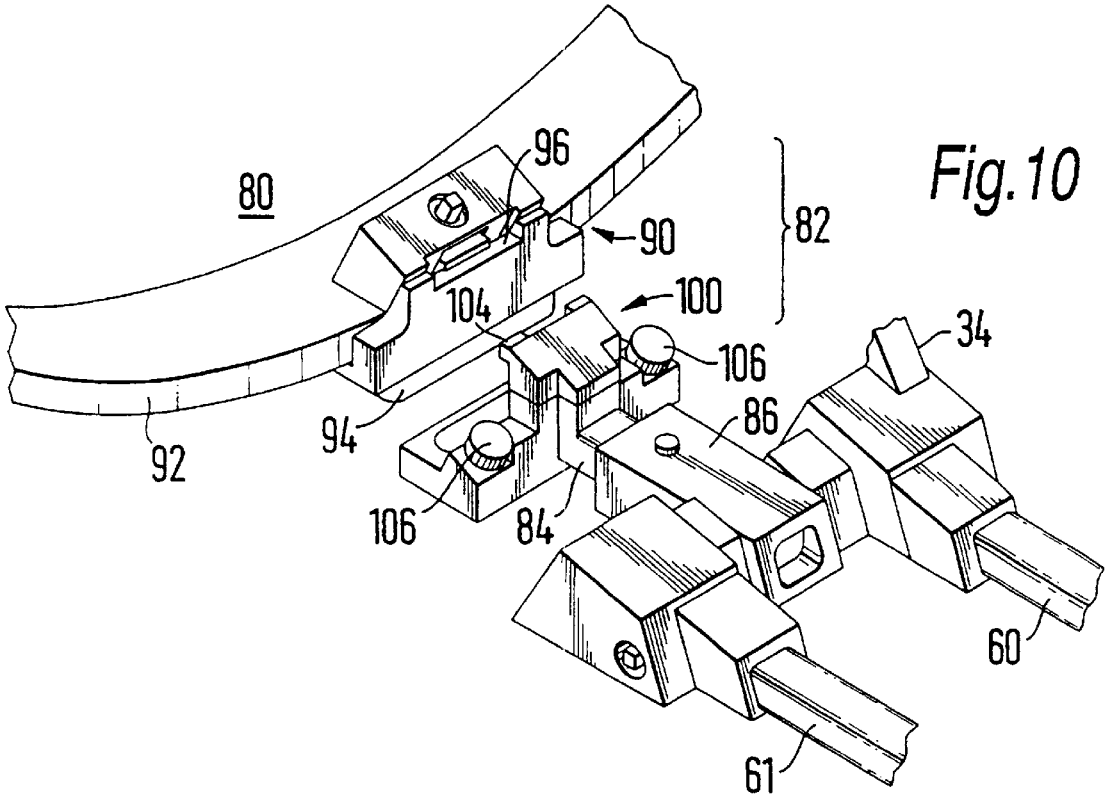
FIG. 10 shows details of a drum clamp used to attach the device of FIG. 1 to a drum.
Figure 11:
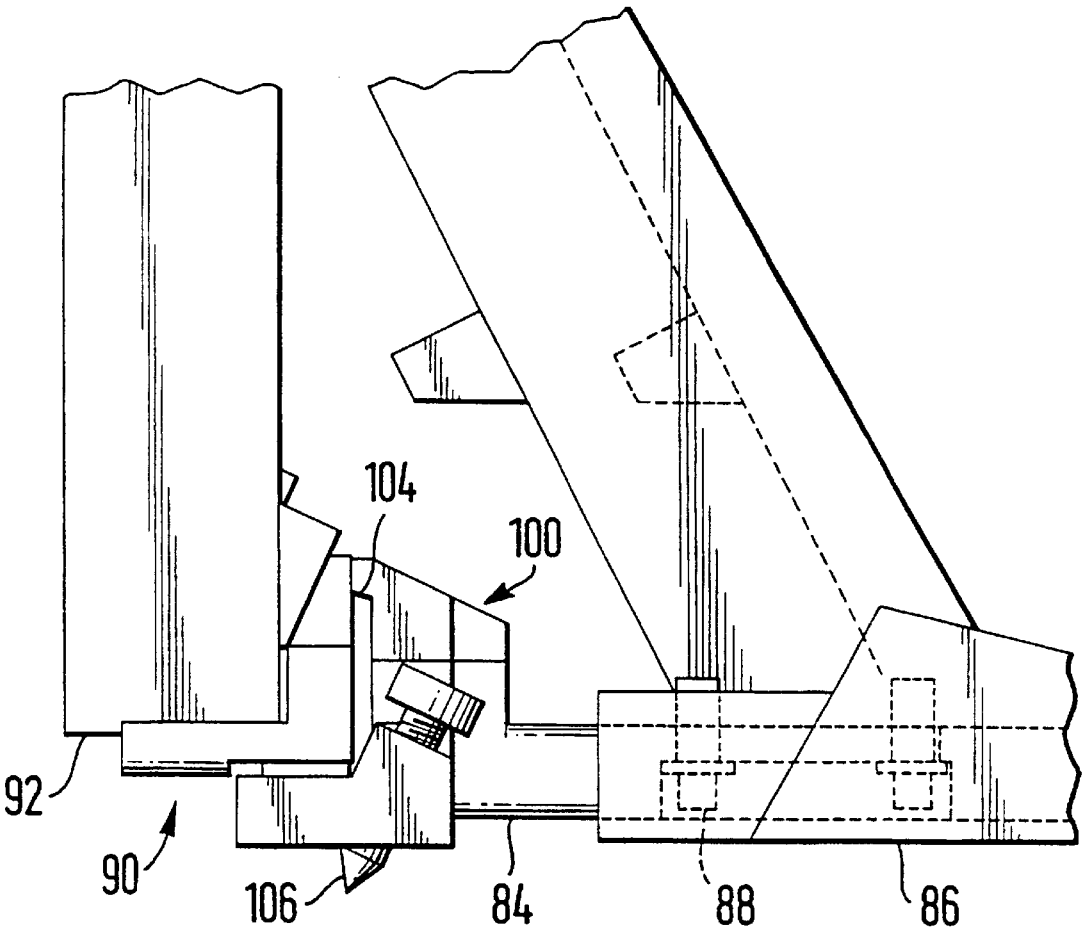
FIG. 11 shows details of part of the drum clamp of FIG. 10.
Figure 12:
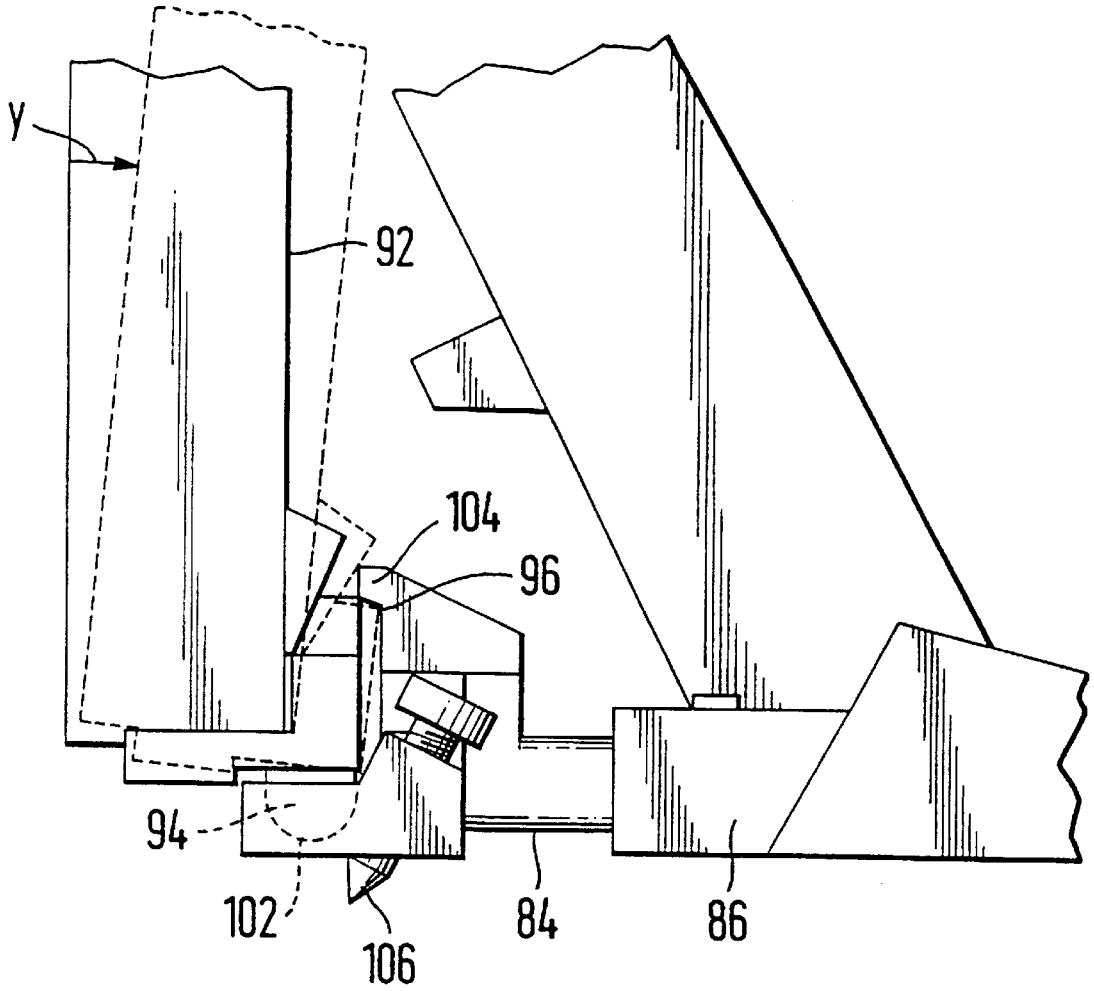
FIG. 12 shows schematically the flexibility of the drum clamp of FIG. 10.

The attachment of the device 20 to a drum 80 is illustrated in FIG. 10, in which support 35 has been omitted for clarity. A drum clamp 82 is mounted on the end of arm 84 which slides in, and is lockable with respect to, housing 86. The housing is disposed midway between supports 34, 35. The length of arm 84 extending from the housing 86 is chosen to attain the desired spacing between the device 20 and the drum 80, and then the arm 84 and housing 86 are fastened together by tightening screw 88.

The drum clamp 82 is formed in two parts which consist of a rim clamp 90 and a rim clamp holder 100 which is attached to the arm 84. The rim clamp 90 has a pair of opposed jaws which have a profile to grip snugly the arcuate rim 92 of the drum 80. An elongate rib 94 is provided on the underside of rim clamp 90, and a corresponding recess 102 is provided in the rim clamp holder 100. When the two parts of the drum clamp 82 are interlocked together the rib 94 rests in recess 102 whilst lip 104 bears against shoulder 96. The lip 104 is formed of nylon whose resilience provides a force acting on the shoulder 96 which urges the rib 94 into the recess 102. The engagement between the lip 104 and shoulder 96 is achieved through a "snap-fit" action.

The rib 94 has a semi-circular cross-section, facilitating a small amount of sliding movement between the rib and the recess 102. This enables the rim clamp 90 to pivot independently of the rim clamp holder 100 about an axis along the length of the rib 94. Thus, when the rim clamp 90 is clamped to the rim 92, the playing face of the drum is able to tilt through angle (y) towards the device 20, facilitating engagement between the lip 104 and shoulder 96.

The rim clamp holder 100 has screw-threaded, ground-engaging spikes 106 which provide additional grip between the floor and the device 20 when engaged.

Figure 13:
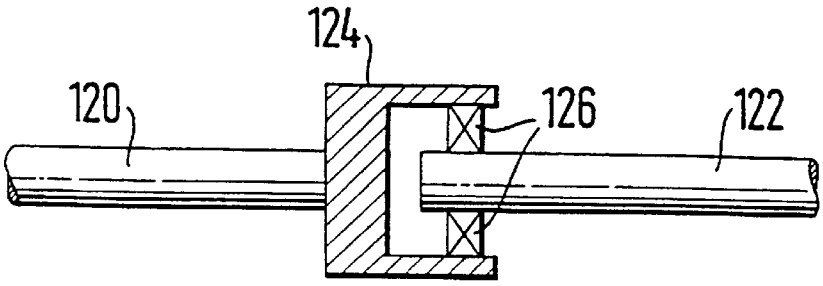
FIG. 13 shows schematically a shaft coupling for use with twin drum beaters.

The device 20 may be adapted to carry twin drum beaters. In such an arrangement, one of the drum beaters is driven by pedal 22 in the way previously described, whilst the other drum beater is operated by a separate foot pedal device. The drum beaters are mounted on separate shafts 120, 122 which are coupled concentrically in between supports 34, 35. As shown in FIG. 13, one of shafts 120 has a housing 124 attached to the end adjacent the other shaft 122. The housing 124 holds bearing 126 which supports the shaft 122. The bearing 126 enables the shafts 120, 122 to be rotated independently of each other. A spare rest 52' is provided on supported 35 to enable a second elastomeric strip to be used with the second drum eater.

What is claimed is:

1. Apparatus for coupling a pedal operated drum beater device to a drum having a drum rim, comprising a first part having means for attachment to the rim of the drum, a second part which in use is attached to the pedal operated drum beater device, the first and second parts being releasably interlockable through the pivotable engagement of one part with the other, wherein the first and second parts comprise a member attached to one part and a recess in the other part, the member being nested in the recess when the parts are pivotally engaged.

2. Apparatus according to claim 1, in which the member has a curved periphery, with the recess having a corresponding profile.

3. Apparatus according to claim 1, in which one of the parts comprises a resilient portion which bears against the other part, urging the member into the recess, when the parts are interlocked.

4. Apparatus according to claim 1, in which the member and recess are elongate and have a longitudinal axis, the longitudinal axis being aligned substantially parallel to a playing surface of the drum when attached to the pedal operated drum beater device.

5. Apparatus according to claim 1, in which the first and second parts interlock with a snap fit action.

* * * * *